US007374073B2

(12) United States Patent
Eigenmann

(10) Patent No.: US 7,374,073 B2
(45) Date of Patent: May 20, 2008

(54) APPARATUS FOR FEEDING A BAND-TYPE MATERIAL TO A PRESS

(75) Inventor: Oskar Eigenmann, Arbon (CH)

(73) Assignee: Bruderer AG, Frasnacht (CH)

( * ) Notice: Subject to any disclaimer, the term of this patent is extended or adjusted under 35 U.S.C. 154(b) by 140 days.

(21) Appl. No.: 11/252,233

(22) Filed: Oct. 17, 2005

(65) Prior Publication Data

US 2006/0097939 A1 May 11, 2006

(30) Foreign Application Priority Data

Nov. 5, 2004 (EP) ..... 04026367

(51) Int. Cl.
*B65H 20/00* (2006.01)

(52) U.S. Cl. ..... 226/154; 226/155

(58) Field of Classification Search ..... 226/151, 226/152, 154, 155, 60, 35, 140, 142
See application file for complete search history.

(56) References Cited

U.S. PATENT DOCUMENTS

| | | | | |
|---|---|---|---|---|
| 3,784,075 | A * | 1/1974 | Portmann | 226/143 |
| 4,304,348 | A | 12/1981 | Kato | |
| 4,792,074 | A | 12/1988 | Bareis et al. | |
| 5,026,336 | A * | 6/1991 | Messner | 475/224 |
| 5,102,026 | A | 4/1992 | Messner | |
| 5,163,595 | A * | 11/1992 | Messner | 226/154 |
| 5,358,164 | A * | 10/1994 | Messner | 226/142 |
| 5,868,296 | A * | 2/1999 | Gentile et al. | 226/35 |
| 5,992,722 | A * | 11/1999 | Strick et al. | 226/152 |
| 6,662,988 | B2 * | 12/2003 | Eigenmann | 226/142 |
| 6,869,002 | B2 * | 3/2005 | Eigenmann | 226/154 |
| 7,111,766 | B2 * | 9/2006 | Eigenmann | 226/154 |
| 2003/0075580 | A1 | 4/2003 | Eigenmann | |
| 2004/0004102 | A1 | 1/2004 | Eigenmann | |

FOREIGN PATENT DOCUMENTS

| | | |
|---|---|---|
| DE | 30 01 271 | 9/1980 |
| DE | 3623647 | 1/1988 |
| EP | 0 366108 | 5/1990 |
| EP | 1 304 181 | 4/2003 |
| EP | 1 380 366 | 1/2004 |
| JP | 8-281355 | 10/1996 |

OTHER PUBLICATIONS

English Abstract of JP 8-281355 dated Oct. 29, 1996.

* cited by examiner

*Primary Examiner*—Evan H Langdon
(74) *Attorney, Agent, or Firm*—Ladas and Parry LLP

(57) ABSTRACT

A feed apparatus for intermittently feeding band-shaped material to a press has two feed rollers for advancing the material. An upper feed roller is bearing-mounted in a rocker for swivel-movement with a pivot bearing on a unidirectionally hydraulic cylinder into a high-lifted position enabling introduction of the material between the rollers. For lowering of the upper roller, the cylinder is rendered pressureless and a press spring pressed onto the material between the rollers. In this position, the pivot bearing can be fixed for automatically adjusting the feed apparatus to the thickness of the material.

30 Claims, 5 Drawing Sheets

APPARATUS FOR FEEDING A BAND-TYPE MATERIAL TO A PRESS

Figure 1A:
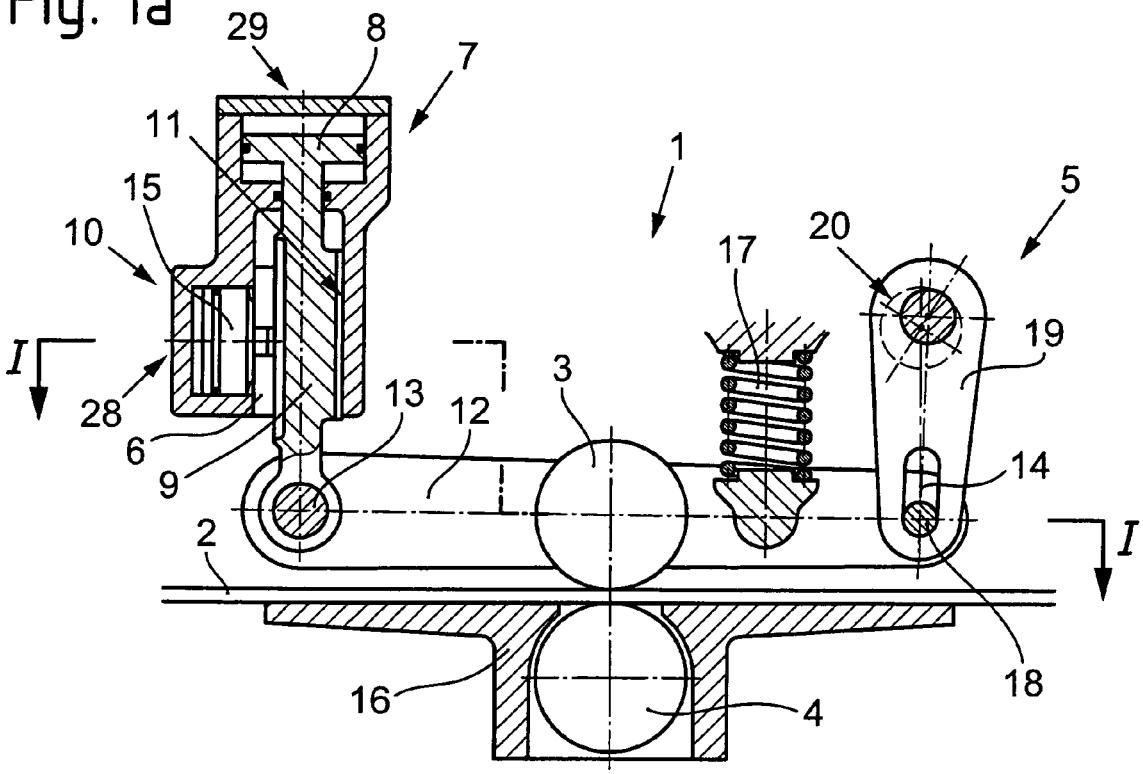

This invention concerns an apparatus for the preferably intermittent feeding of a band-type (e.g., band-shaped) semi-finished (e.g., unfinished) material to a press and a method for adjusting the band thickness of a feed apparatus for the feeding of a band-type material.

At the industrial fabrication of small press and punch parts, nowadays high-speed presses are used to which a band-type semi-finished material is intermittently fed by means of a synchronised feed apparatus. In this case, the material band is clamped in the feed apparatus between two feed rollers arranged one above the other and is advanced by means of an intermittent rotary movement of them. Depending on the use, between two feeding intervals in each case the clamping of the material band is suspended (intermediate lifting) in a certain time-slot in order to make possible an exact positioning of the band in the press, e.g. by means of a pilot pin, in advance to the press or punching action, respectively. This is accomplished in that the upper feed roller in each case is short-time lifted from the band material. Thereby, it is essential that the feed apparatus is always exactly set to the thickness of the band material in order to ensure that, during the feeding action, the required clamping force between the feed rollers is achieved and, at the same time, the beginning and the duration of the intermediate lifting correspond to the technical requirements of the process. For this purpose, the feed apparatus at the introduction of a new material band in each case is individually set anew to the thickness of same by lifting (high lifting) the upper feed roller from the band material with a spindle drive or a hydraulic cylinder, arranging the new band material between the feed rollers and then placing down again the upper feed on the band material by actuating the spindle drive or the hydraulic cylinder. In this case, the return movement must be controlled by an experienced machine operator so that the upper feed roller takes a specific position relative to the band-type material.

Only in this way is it possible to ensure with these feed apparatuses that the other settings, which concern the clamping force and the time-slot for the intermediate lifting, remain unchanged during the processing of material bands with different thicknesses.

This has, however, the disadvantage that a complete automation of the production with the presently known feed apparatuses is not possible and that the regularly required adjustment of the band thickness is time-consuming and, moreover, can only be carried out by experienced machine operating personnel.

Therefore, the task to be solved is to provide an apparatus for feeding a band-type material to a press and a method for adjusting the band thickness of a feed apparatus for feeding a band-type material which do not have the disadvantages of the state of the art or which at least partially avoid them.

This task is solved by the apparatus and by the method according to the independent patent claims.

A first aspect of the invention concerns an apparatus for the preferably intermittent feeding of a band-type semi-finished material to an intermittently working press. The apparatus comprises two feed elements arranged opposite each other, between which a band-type material that is to be advanced, in feeding operation is clamped and then in a non-positive manner can be advanced with them. As feed elements, feed rollers, roller segments or also pliers-type configurations can be adopted. The feed apparatus also comprises high-lifting means with associated first drive means according to the claims, which can be formed for example from a hand crank, an electro-motor or a hydraulic or pneumatic cylinder. The high-lifting means are connected to the two feed elements in such a way that, for high-lifting in the non-feeding operation, one of the two feed elements, from a position that is closer to the other feed element, which can for example correspond to the position in which, with a previously performed feeding action, a band-type material was clamped between the feed elements, is moveable into a position that is more remote from this (high-lifted position), in which the clearance between the two feed elements is large enough in order to position without any complication a new band-type material between the feed elements.

Furthermore, the apparatus comprises band thickness adjusting means with a positioning element. The positioning element is connected in such a way to that particular feed element, which is moveable with the high-lifting means, that, during the movement of this feed element between the high-lifted position and the position that is closer to the other feed element, it performs a movement to and fro between a first and a second position, which is preferably achieved by a positive coupling in both directions of movement of the positioning element and the feed element. Moreover, the band thickness adjusting means comprise non-positive and/or positive locking means by which the positioning element can be locked in a desired position between the first and the second position, in order to fix the feed element that is connected to it, in a desired band thickness position. Here, the high-lifting means are designed or coupled to the feed element that is moveable with them in such a way that, with the first drive means, a force can be exerted onto the feed element only in the direction of movement towards the high-lifted position but not, however, in the opposite direction. Thus, the high-lifting means are merely suitable for accomplishing the movement of the feed element, which is moveable with them, from the position that is closer to the other feed element into the high-lifted position with the help of their first drive means and then, as required, for holding the feed element connected to these in the high-lifted position. It is, however, not possible to transfer a drive force generated from the first drive means in the opposite direction onto the feed element moveable with these, meaning in the direction away from the high-lifted position and towards the other feed element. This can for example be achieved in such a way that, as first drive means, a unidirectional hydraulic or pneumatic cylinder which can be operated only in the direction towards the high-lifted position, is used, or for example in that a spindle nut is advanced by a spindle driven by an electro-motor as a first drive means, which is only in the movement direction towards the high-lifted position positively coupled to the feed element, and which, in the other direction of movement, runs into empty space. Accordingly, a reset movement of the feed element operatively connected with the high-lifting means and of the positioning element coupled with these for the purpose of adjusting the feed apparatus to the thickness of a band-type material to be processed, for which purpose this feed element from the high-lifted position into a band thickness position, in which the feed element lies on the band-type material which is to be advanced and is arranged between the two feed elements, after a neutralisation of the high-lifting means, e.g. at the previously mentioned examples by means of a pressureless switching of the hydraulic or pneumatic cylinder, resp., or by means of a return movement of the spindle nut into empty space, is exclusively accomplishable by resetting forces independent of the drive forces of the first drive means.

By this, the advantage is arrived at, that the return movement and the touchdown of the feed element coupled with the high-lifting means, onto the band-type material is controllable independently of the drive force of the first drive means so that, in an uncomplicated manner, e.g. by way of springs and/or weights, a pressing force which is essentially the same at all times can be ensured during the positioning of the feed element in the band thickness position. If the positioning element is locked with the feed element being put down on the band-type material in this way, there is automatically always the same pressing force independent of the band thickness. Therefore, the feed apparatus according to the invention is capable to adjust itself to the thickness of the individual band material without any control measurements, a fact that is beneficial for the realisation of automatic production plants.

In a preferred embodiment of the feed apparatus, the resetting forces are produced exclusively by weight and/or spring forces, through which resetting and pressing forces of an essentially constant magnitude can be provided in a cost-favourable and precise manner.

In a further preferred embodiment of the apparatus, the positioning element at the same time forms a part of the high-lifting means, through which there is the advantage that the apparatus can be constructed from relatively few individual parts.

If the positioning element of the apparatus is guided along a guide, and is lockable within this guide by frictional connection with clamping surfaces, it can then securely and iinfinitely variable be locked and the advantage is arrived at that a particularly precise band thickness adjustment is possible.

In yet a further preferred embodiment of the apparatus, the positioning element during its movement between the position, in which the feed element, which is moving-connected with it, together with the other feed element clamps the band-type material, and the high-lifted position, performs a translatoric movement or a movement along a curved path, a fact that simplifies the provision of suitable locking means.

In yet a further preferred embodiment, the apparatus is designed for the intermittent feeding of a band-shaped semi-finished material to a press. Here the apparatus has intermediate lifting means which are driven by second drive means according to the claims and are coupled to one of the two feed elements in such a way that this feed element, in each case between two successive feeding intervals, is lifted from the clamping position, which is closer to the other feed element, into an intermediate lifting position, which is more remote from the other feed element, so that the clamping of the band-type material is temporarily suspended. Such an apparatus makes possible a precision positioning of the band-type material by the press prior to every working cycle, e.g. by means of pilot pins arranged at the tool of the press, which engage positioning openings in the band-type material, since this is temporarily released by the feed apparatus.

In this case it is preferred if the locking of the positioning element can take place at a point in time in which the intermediate lifting means are arranged in an operating position which during the feeding operation corresponds to the beginning of the intermediate lifting. By this it becomes possible, when adjusting the band thickness, to also automatically set the beginning of the intermediate lifting or to ensure, resp., that this is always the same independent of the band thickness.

In a preferred embodiment of the feed apparatus equipped with means for the intermediate lifting, the particular feed element, which is coupled with the high-lifting means, at the same time also forms the feed element which is coupled with the intermediate lifting means. Thus, the high-lifting means and the intermediate lifting means act on a common feed element, so that the other feed element at least in the clamping force direction can be designed in a non-moveable manner.

Preferably, the feed elements of the feed apparatus according to the invention are designed as feed rollers or as feed roller segments, so that the advancing movement can be accomplished by a rotation of the same. However, it is also conceivable to design these in a pliers-style manner and to accomplish the advancing movement by means of a parallel translatoric movement of same.

In the case of feed apparatuses with intermediate lifting means, it is preferred if that particular drive roller or that particular drive roller segment which is coupled with the intermediate lifting means is mounted in a rocker, which, in the area of one of its two ends, is tiltably mounted in a pivot bearing and in the zone of its other end is coupled with the drive means of the intermediate lifting means (the second drive means according to the claims), so that it can be swivelled to and fro with these drive means around the pivot bearing between a clamping position and an intermediate lifting position. In this way, a sturdy and precise suspension of the feed roller or the feed roller segment, resp., can be realised, and it additionally becomes possible to step-up or a step-down movement forces and movement paths in an uncomplicated manner.

In a preferred embodiment of the apparatus with rocker described above, the pivot bearing of the rocker is coupled to the high-lifting means in such a way that the position of the pivot bearing is changeable within the apparatus by means of the first drive means, namely in the direction towards a position corresponding to the high-lifted position.

It is advantageous in this respect if the pivot bearing is formed by the positioning element of the feed apparatus, by which the position of the feed element in a band thickness position is fixed because, in this way, a sturdy locking as near as possible to the feed element concerned is possible without adding-up of additional clearances.

In yet another preferred embodiment of the feed apparatus with rocker, the intermediate lifting means and the high-lifting means share at least one structural component, preferably a bearing location of a lever mechanism, whose position is changeable within the apparatus by means of the first drive means.

It is preferred in this case that the common structural component should, at the same time, be formed by the positioning element of the apparatus. It is also preferred that, with such apparatuses, the pivot bearing of the rocker should have a fixed position within the apparatus. By this it becomes possible to realise particularly compact apparatuses with few moving parts, whereby furthermore the precision can be increased and the manufacturing costs can be reduced.

In a further preferred embodiment of the feed apparatus according to the invention, the first drive means consist of a preferable unidirectional acting hydraulic or pneumatic cylinder, through which a drive for the high-lifting means can be provided in an extremely simple manner which, despite of the positive coupling, can produce drive forces in one direction only and which can be neutralised in an uncomplicated manner by means of pressureless switching.

If an extension of the piston rod of the hydraulic or pneumatic cylinder is selected as a positioning element in this case, the number of moving structural components of the apparatus can further be reduced, with the result that no unnecessary adding-up of clearances occurs.

In yet another preferred embodiment of the apparatus, the locking means have preferably a unidirectional acting hydraulic or pneumatic cylinder for actuating the locking, wherein it is preferred if the locking is effected by clamping under a compressive force generated by this cylinder. In this way, a reliable and infinitely variable acting locking of the positioning element can be realised in a simple manner.

If the first drive means, the positioning element and the locking means in this case are formed as a coherent unit, there results a compact and sturdy functional unit which can be used on a modular basis for various types of feed apparatuses.

In yet a further preferred embodiment, the apparatus according to the invention comprises control means by which an automatic band thickness adjustment can be performed in that the feed element coupled with the high-lifting means is automatically brought, with the help of the resetting forces, from the high-lifted position into a band thickness position, in which it lies on the band-type material which is arranged between the two feed elements and abuts the other feed element and/or a guide table.

In this band thickness position, the positioning element is then automatically locked with the locking means. By this, it becomes possible to carry out the band thickness adjustment in a fully automatic manner and, consequently, to save time and costs.

If the apparatus as described above comprises means for intermediate lifting, then it is of advantage if, before the locking of the positioning element, the intermediate lifting means are automatically brought into a specific state, namely into a state which corresponds to the desired beginning of the intermediate lifting during the subsequent feeding operation. In this way, it can be automatically ensured that, during feeding operation, there is always the same intermediate lifting time-slot, even if the band thickness varies from band to band.

A second aspect of the invention concerns a method for adjusting of the band thickness of a feed apparatus for the preferable intermittent feeding of a band-type material, which preferably is constructed according to the first aspect of the invention. In any case, the apparatus that is to be adjusted with the method according to the invention comprises two feed elements located opposite each other, by means of which the band-type material to be advanced in feeding operation is advanced while being clamped by them. Moreover, in the non-feeding operation, for enabling an introduction of the band-type material into the area between the two feed elements, one of the feed elements can be moved with high-lifting means with first drive means in direction away from the other feed element into a high-lifted position. In a first method step, the one feed element which is moveable with the high-lifting means is brought into a high-lifted position under activation of the first drive means. In a second method step, a band-type material is then introduced into the area between the two feed elements. In a third step, the force of the high-lifting means is then neutralised, under simultaneous exclusion of a transmission of drive forces from the first drive means onto the feed element in a direction of movement which is opposite to the high-lifting movement, which for example can be accomplished as described under the first aspect of the invention.

In a fourth method step, the feed element moveable with the high-lifting means is moved by resetting forces, which are independent of the drive forces of the first drive means, from the high-lifted position in the direction opposite to the high-lifting movement into a band thickness position, in which it lies on the band-type material which is arranged between the two feed elements and lies on the other feed element and/or on the feed table, by which a positioning element, which is moving-connected with this feed element, is positioned in a certain position; in a fifth method step, the feed element is then locked in this band thickness position by locking the positioning element movably joined to it in this certain position with locking means.

By this, as already in the case of the apparatus according to the first aspect of the invention, the advantage is arrived at that the return movement and the touchdown of the feed element coupled with the high-lifting means onto the band-type material is controllable independently of the drive force of the drive means deployed for the high-lifting. Thus, it becomes possible to use different drive means for the high-lifting movement, which requires relatively large forces with low-level precision, and for the return or touchdown movement, resp., for which low-level but as far as possible constant forces are required. By this, there is the advantage that the drive means can optimally be designed for their respective functions, so that self-adjusting feed apparatuses can be realised with uncomplicated and sturdy means and without sophisticated control technology.

Springs and/or weights are preferably used here as drive means for the return or touchdown movement, resp., because they do not require any additional control and can provide reliable and essentially constant forces in the required magnitude.

If the positioning element is guided translatorically or in a curve along a guide and locked within this guide by means of clamps, which is preferred, a particularly sturdy and moreover infinitely variable locking becomes possible.

In a preferred embodiment of the method, in which the apparatus used is designed for intermittent feeding of a band-type material and has intermediate lifting means, as described under the first aspect, for temporary release of the band-type material, the intermediate lifting means before the locking of the positioning element are brought into a specific state, which preferably corresponds to that particular state which they have in the feeding operation at the beginning of the intermediate lifting. By this it is ensured that the time-slot for the intermediate lifting is always identical, independent of the band thickness.

In yet another preferred embodiment of the method according to the invention, at least the third, the fourth and the fifth method step are carried out with the help of a preferable electronic control system, by which the integration of the apparatus in an automatic production line becomes possible.

Figure 1B:
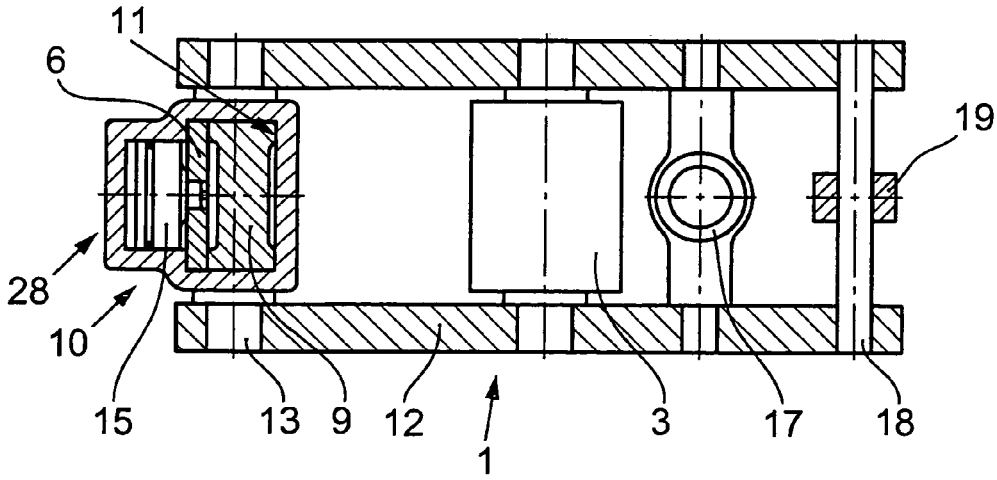
Figure 2A:
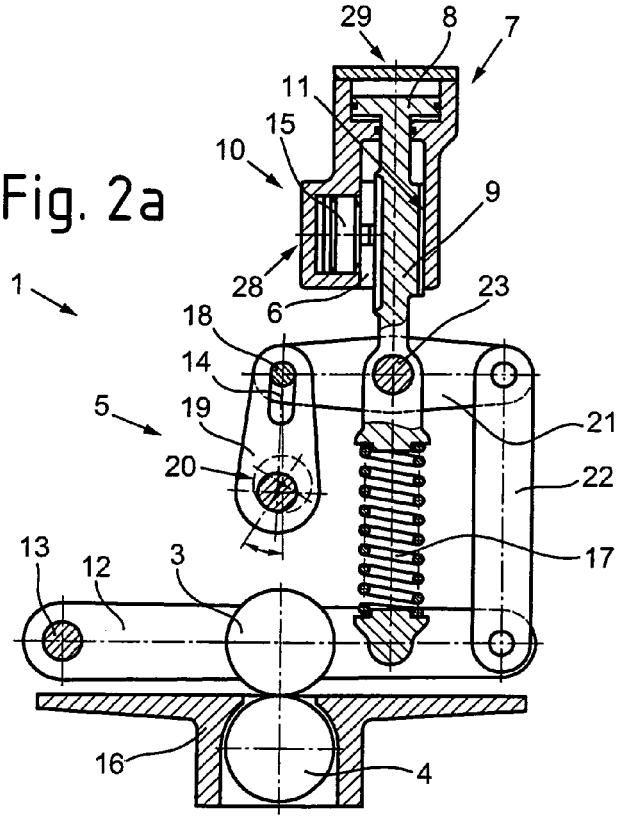
Figure 2B:
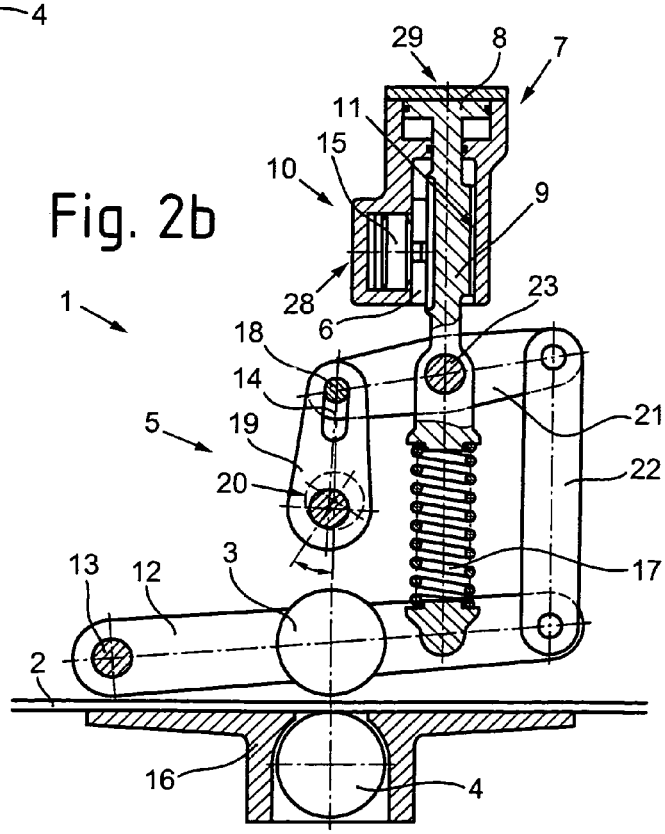
Figure 3A:
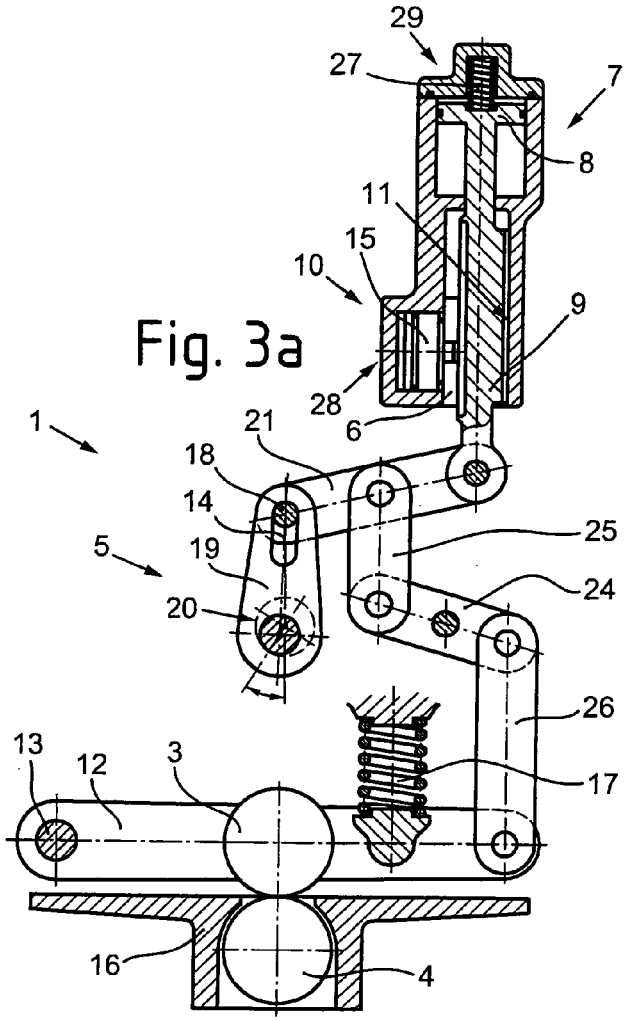
Figure 3B:
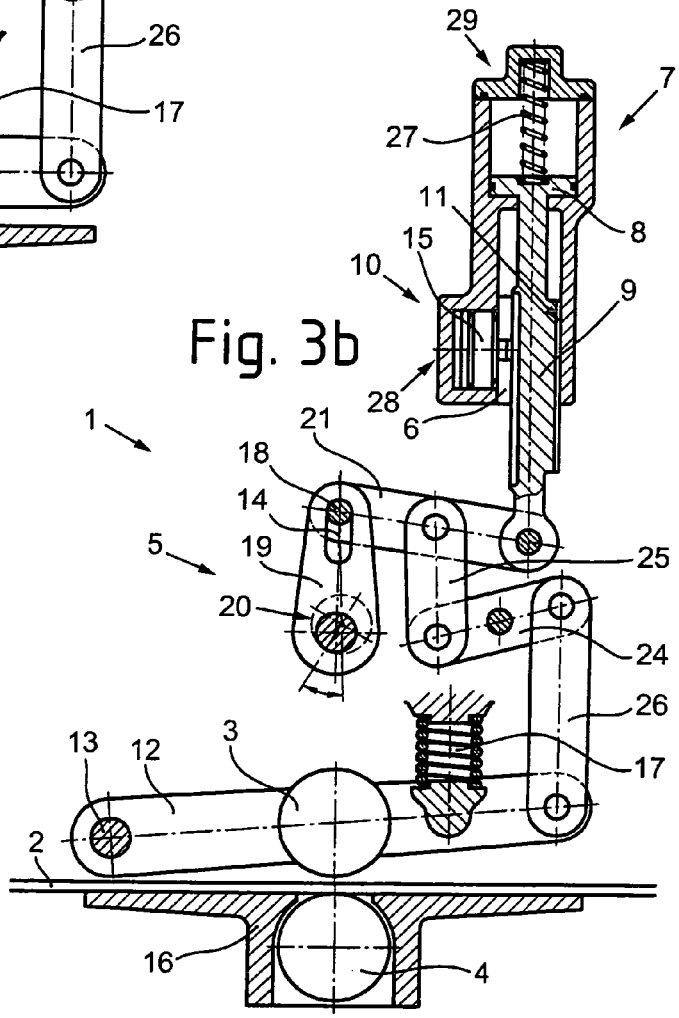

Further preferred embodiments of the invention result from the dependent claims and from the now following description based on the figures. Therein shows:

FIG. 1*a*: a vertical cross-section through a first feed apparatus according to the invention;

FIG. 1*b*: a horizontal cross-section along the line I-I through the feed apparatus from FIG. 1*a*; the FIGS. 1*c* to 1*g*: the feed apparatus from FIG. 1*a* in various operating states in the vertical cross-section;

FIG. 2*a*: a vertical cross-section through a second feed apparatus according to the invention;

FIG. 2*b*: the feed apparatus from FIG. 2*a* in a high-lifting operating state in the vertical cross-section;

FIG. 3*a*: a vertical cross-section through a third feed apparatus according to the invention; and FIG. 3*b*: the feed apparatus from FIG. 3*a* in a high-lifted operating status in the vertical cross-section;

The basic structure of a feed apparatus 1 according to the invention for the intermittent feeding of a band-type material 2 to a punch press (not shown) is evident from the FIGS. 1*a* and 1*b*. As can be seen, the apparatus 1 comprises two parallel feed rollers 3, 4 arranged above each other, which can be put intermittently into rotation by an electro-motor (not shown) for the purpose of intermittently advancing a band-type material 2 clamped between them.

The lower roller 4 is mounted in a bearing in a stationary feed table 16, whereas the upper roller 3 is mounted in a bearing in a rocker 12, which is tiltably mounted in a pivot bearing 13 in the area of its left end.

In the area of its other end, the rocker 12 is subjected to a spring force acting downwards by means of a screw spring 17 and supported by way of a bolt 18 in the slotted hole 14 of a connecting rod 19, which connecting rod 19 can be moved up and down by means of an eccentric shaft 20 which can be driven at a synchronous angle to the main shaft of the punch press by a servo motor (not shown). In this way it is possible to raise the upper roller 3 at a synchronous angle to the working cycle of the punch press by lifting the right end of the rocker 12 with the connecting rod 19 opposed to the force of the spring 17 into an intermediate lifting position, in which the clamping of the band-type material 2 between the feed rollers 3, 4 is temporarily suspended and a correction of the band position, e.g. by means of pilot pins attached to the punch tool, is possible. Servo motor, eccentric shaft 20, connecting rod 19, bolt 18 and rocker 12 form, in the case presented here, the intermediate lifting means according to the claims.

The pivot bearing 13, in which the left end of the rocker 12 is mounted, is formed from the lower end of a vertically mobile skid 9, which is guided in the machine housing along vertical guides 11 and, at that location by means of a clamping strip 6, which can be subjected to a compressive force with the piston 15 of a hydraulic cylinder 28, can be solidly clamped in a desired position in the guide 11. The hydraulic cylinder 28 with piston 15, the clamping strip 6 and the guide 11, in the case presented here, form the locking means 10 according to the claims.

The mobile skid 9, which represents positioning element 9 according to the claims, is formed as an extension of the piston rod of a further unidirectional acting hydraulic cylinder 29 with a piston 8 which can merely produce a force in the vertical upward direction, but not however a force in the vertical downward direction. Accordingly, it is possible with deactivated locking means 10, to raise the skid 9 and with this the pivot bearing 13 by means of an upward motion of the piston 8 in the hydraulic cylinder 29 until this has a surface contact at the cylinder cover and a maximum stroke position is reached. Here and at the same time, the left end of the rocker 12 is lifted and the upper feed roller 3 is lifted from the band-type material into a high-lifted position, in which the gap between the feed rollers 3, 4 is at a maximum. This raising is called "high-lifting" and is normally carried out when a new band-type material is to be introduced into the zone between the two feed rollers 3, 4. The hydraulic cylinder 29 with the piston 8, the skid 9 and the rocker 12 form in this case the high-lifting means 7 according to the claims.

A method according to the invention for adjusting the band thickness is now explained on the basis of the FIGS. 1*c* to 1*g*, which show the feed apparatus according to FIG. 1*a* in various operating states in the vertical cross-section.

Figure 1C:
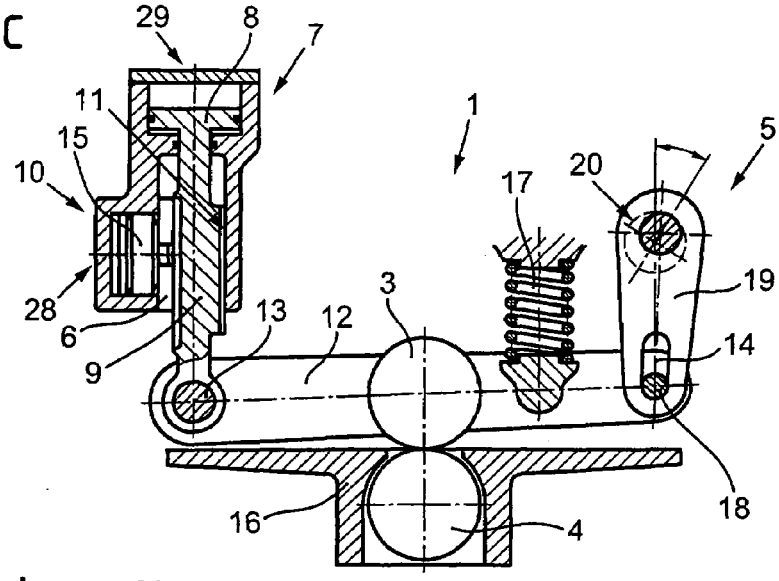

In the situation shown in FIG. 1*c*, no band-type material 2 is arranged between the two feed rollers 3, 4 and the upper roller 3, pressurised by the spring force of the screw spring 17, lies on the lower roller 4, as bolt 18 lies at the lower end of the slotted hole 14 of the connecting rod 19 and the hydraulic cylinder 29 with the piston 8 of the high-lifting means 7 is in a pressureless state. Here, the eccentric shaft 20 and the connecting rod 19 are each arranged in a position which corresponds to their position at the beginning of the intermediate lifting in the feeding operation.

Figure 1D:
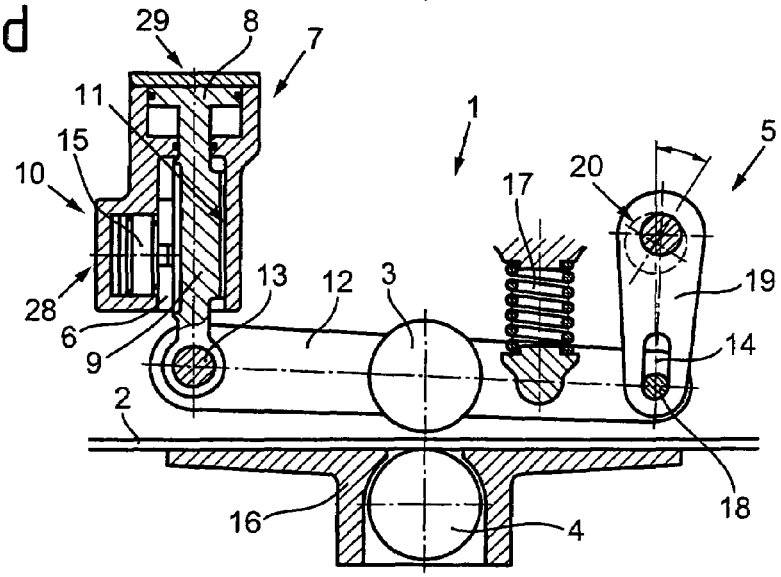

If now a band-type material 2 is to be arranged between the two feed rollers 3, 4 and be clamped with these for the purpose of advancing, the unidirectional acting hydraulic cylinder 29 of the high-lifting means 7 is activated by applying pressure oil to its piston on the lower side, whereupon it travels upwards against the cylinder cover and lifts the upper feed roller 3 over the skid 9 and the rocker 12 into the high-lifted in which the band-type material 2 can be introduced between the two feed rollers 3, 4. This situation is shown in FIG. 1*d*.

For adjusting the feed device 1 to a thickness of the band-type material 2 and for clamping same between the feed rollers 3, 4, the hydraulic cylinder 29 with the piston 8 is subsequently again rendered pressureless, through which its effect is deactivated or neutralised respectively. In consequence, the piston 8 of the hydraulic cylinder 29 lowers together with the skid 9 and the rocker 12, with a turning of same around the bolt 18 arranged at its right end, until the upper feed roller 3 lies on the band-type material 2 and presses it against the lower feed roller 4 with pressure force application by the spring 17, so that the band-type material 2 is clamped between the two feed rollers 3, 4. Here, the return movement from the high-lifted position into this clamping position is exclusively accomplished by the weight forces of the moved parts 8, 9, 12, 3 and by the spring force of the spring 17. Following this, the locking means 10 are activated by pressurizing the piston 15 of the hydraulic cylinder 28 with pressure oil on its left side, through which this exerts a compressive force onto the clamping strip 6 and clamps the skid 9 in the guide 11.

Figure 1E:
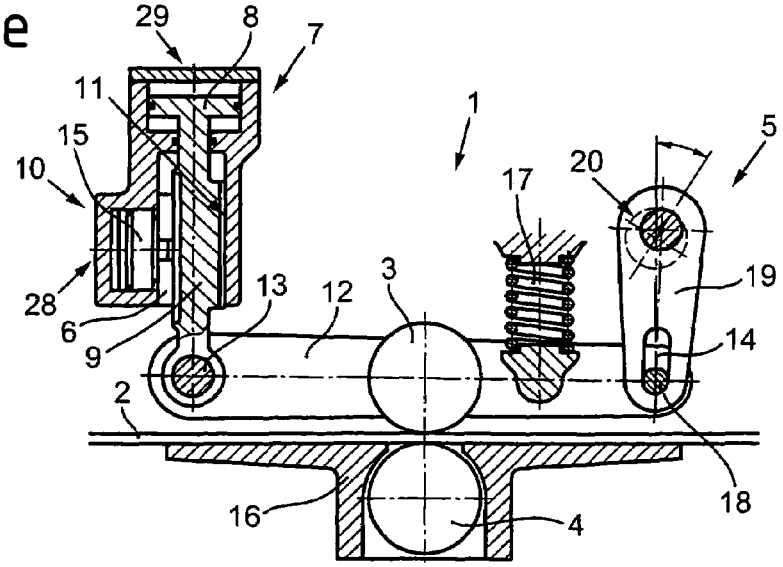
Figure 1F:
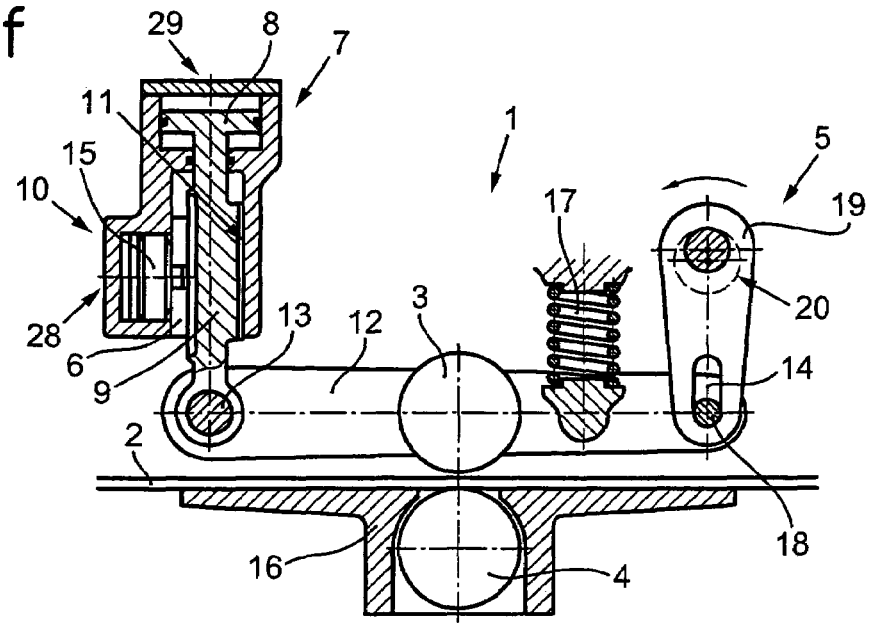
Figure 1G:
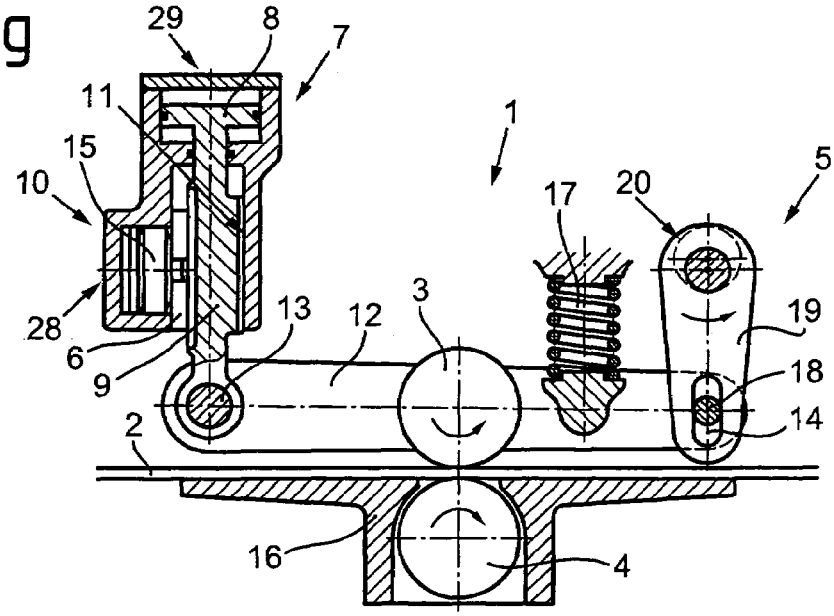

The apparatus is now set to the thickness of the band-type material 2 and can start its feeding operation which is shown in the FIGS. 1*f* and 1*g*. As can be seen in FIG. 1*f*, the startup of the servo motor of the intermediate lifting means 5 is followed by an intermediate lifting of the rollers 3, 4, by temporarily lifting the upper roller 3 from the band-type material 2 by a raising of the rocker 12 at its right end by means of the connecting rod 19, so that the clamping of the material is temporarily suspended.

After the upper feed roller 3 has again touched down on the band-type material 2, the connecting rod 19 still lowers itself a little until the bolt 18 is positioned between the two ends of the slotted hole 14 of the connecting rod 19. In this operating position, there are defined conditions concerning the clamping forces of the rollers 3, 4, because the swivel movement of the rocker 12 around the rotary joint 13 is limited exclusively by the resting of the upper feed roller 3 on the band-type material 2. Now, the feed rollers 3, 4 are temporarily rotated in opposite directions, through which the band-type material 2 is advanced by a certain amount. This situation is shown in FIG. 1*g*.

If the feeding operation is continued, the operating situations as shown in the FIG. 1*f* to 1*g* are repeated until the material band 2 has been used up and a new must be provided. If at that occasion the feed apparatus 1 shall be adjusted to the thickness of the new band-type material 2, the steps as described pursuant to FIG. 1*c* to 1*e* are to be carried out before the renewed startup of the feeding operation.

As can be seen, at the feed apparatus 1 according to the FIG. 1*a* to 1*g*, the hydraulic drive 29 for the high-lifting means 7, the skid 9 and the locking means 10 are executed as a coherent unit. This unit is also used in the feed apparatus 1 according to the FIGS. 2*a* and 2*b*, together with the arrangement applied in the preceding embodiment example consisting of a stationary feed table 16 with lower feed roller 4 and the rocker 12, end-side mounted in a bearing in a rotary joint 13, with the upper feed roller 3 as well as with the arrangement consisting of eccentric shaft 20, connecting rod 19 with slotted hole 14 and bolt 18 as part of the intermediate lifting means 5. The essential difference to the first embodiment is however that the rotary joint 13, in which the left end of the rocker 12 is mounted, is solidly arranged in the machine housing and that both the high-lifting means 7 as well as the intermediate lifting means 5 are effective at the right end of the rocker 12 by way of a common lever mechanism which consists of a double-sided lever 21 and a pull shackle 22. In this case, the connecting rod 19 of the intermediate lifting means 5 engages at the left end of the double-sided lever 21 and the skid 9 of the high-lifting means 7 at the fulcrum of the lever 21, where it provides for its rotary joint 23 in a vertically slidable manner. The rotary joint 23 of the lever 21, on whose lower side the screw spring 17 acting on the rocker 12 supports itself, forms in this way a common rotary joint both for the high-lifting means 7 as well as for the intermediate lifting means 5, whose position in the machine housing can be changed with the piston 8 of the hydraulic cylinder 29 of the high-lifting means 7 and can be locked with the locking means 10.

The procedure for adjusting this feed apparatus is essentially identical to that described with the first embodiment example. If a band-type material 2 is to be arranged and clamped between the two feed rollers 3, 4 for the purpose of processing, the unidirectional acting hydraulic cylinder 29 of the high-lifting means 7 is activated by pressurizing its piston 8 on the lower side with pressure oil, so that it travels against the cylinder cover.

Thereby, it lifts the rotary joint 23 so that the double-sided lever 21 is swivelled around the bolt 18 located at its left end and, by way of the pull shackle 22, lifts the right end of the rocker 12, thereby lifts the upper feed roller 3 into the high-lifted position, in which the band-type material 2 can be introduced between the two feed rollers 3, 4. This situation is shown in FIG. 2*b*. Following this, the hydraulic cylinder 29 with the piston 8 is again rendered pressureless, through which its effect is neutralised and the rotary joint 23, lever 21, pull shackle 22 and rocker 12 lower themselves until the upper feed roller 3 rests on the band-type material 2 and presses this under pressure force application by the spring 17 against the lower feed roller 4, so that the band-type material 2 is clamped between the two feed rollers 3, 4. Here the return movement from the high-lifted position into this clamping position is accomplished exclusively by the weight forces of the moved parts 8, 9, 12, 3, 23, 22, 21 and by the spring force of the spring 17. Following this, the locking means 10 are activated by applying to the piston 15 of the hydraulic cylinder 28 pressure oil on its left side, through which this exerts a compressive force onto the clamping strip 6 and clamps the skid 9 in the guide 11. Of course, the band-thickness adjustment as described beforehand is performed preferably in an operating situation where the eccentric shaft 20 and its connecting rod 19 take a specific position, e.g. that particular position which they shall take in feeding operation at the beginning of the intermediate lifting.

The feed apparatus according to the invention shown in the FIGS. 3*a* and 3*b* has a similar structure as those shown in the FIGS. 2*a* and 2*b*. Here however, the pulling strap 22 is substituted by a combination of a further double-sided lever 24 and two straps 25 and 26, and the skid 9 is coupled flexibly at the right end of the double-sided lever 21 in interaction with the connecting rod 19. Deviating from the previous embodiment examples, in this example the piston of the hydraulic cylinder 29 needs to be applied with pressure oil on its upper side for the purpose of lifting the upper feed roller 3 into the high-lifted position, on which upper side it is additionally provided with an auxiliary spring 27.

Apart from the already mentioned difference of the direction of pressure application of the hydraulic cylinder, the procedure for adjusting this feed apparatus is substantially identical with that described beforehand and is therefore not described here again.

Even if with all embodiments described here the positioning element according to the claims designed as skid 9 is executed as part of the high-lifting means 7, it is also nevertheless conceivable to design this as a separately engaging structural component, e.g. as a separate, lockable slide. It is moreover envisaged to use other drive means 29 for the high-lifting means 7 than those described, in particular also pneumatic cylinders, electro-motors with spindle drives or also linear type motors.

The invention claimed is:

1. An apparatus for the in particular intermittent feeding of a band-shaped semi-finished material to a press, with two feed elements located opposite each other for the feeding of the band-shaped material in the feeding operation with the clamping of same between the feed elements, with high-lifting means having first drive means coupled with a first of the feed elements for the first of feed elements to be movable from one position, which is closer to a second of the feed elements, into a high-lifted position, which is more remote from the second of the feed elements, in order to enable introduction of the band-shaped material between the feed elements in a non-feeding operation, with band thickness adjusting means having a positioning element coupled with the first of the feed elements for movement between first and second positions, and with locking means by which the positioning element can be locked in a position between the first and second positions, wherein a force of the first drive means is exclusively in the direction towards the high-lifted position of the first of the feed elements, and a resetting movement of the feed elements for adjusting the apparatus to the thickness of the material from the high-lifted position into a band thickness position in which the feed elements lie on the material between the feed elements and, therefore, a positioning of the positioning element in a position corresponding to the band thickness position of the feed element is by resetting forces independent of the force of the first drive means, and wherein the positioning element is guided along a guide and is lockable within this guide by frictional connection with clamping surfaces.

2. The apparatus according to claim 1, wherein the resetting forces are weight and/or spring forces.

3. The apparatus according to claim 1, wherein the positioning element is part of the high-lifting means.

4. The apparatus according to claim 1, wherein the positioning element, during the movement between the high-lifted and other positions, performs a translatoric movement.

5. The apparatus according to claim 1 for the intermittent feeding of a band-shaped semi-finished material to a press, wherein the apparatus has intermediate lifting means with second drive means coupled with one of the feed elements for clamping the material between two successive feeding intervals by moving the one of the feed elements to a clamping position, which is closer to the other of the feed elements, from an intermediate lifted position, which is located more remote from the other of the feed elements for the temporary release of the material.

6. The apparatus according to claim 5, wherein the locking of the positioning element is effected when the intermediate lifting means are in a state which, during a feeding operation, corresponds to a beginning of the intermediate lifting means moving.

7. The apparatus according to claim 5, wherein the first of the feed elements is the one coupled to the intermediate lifting means.

8. The apparatus according to claim 1, wherein the feed elements are feed rollers or feed roller segments.

9. The apparatus according to claim 5, wherein the feed elements are feed rollers or feed roller segments and wherein that particular drive roller or that particular drive roller segment, which is coupled with the intermediate lifting means, is mounted in a rocker which is mounted in a swiveling manner in a pivot bearing in the area of one of its two ends and, in the area of its other end, is coupled with the second drive means of the intermediate lifting means, so that it can be swiveled with these drive means around the pivot bearing.

10. The apparatus according to claim 9, wherein the pivot bearing is coupled with the high-lifting means for changing the position of the pivot bearing relative to an apparatus-fixed system by means of the first drive means.

11. The apparatus according to claim 10, wherein the pivot bearing is formed from the positioning element.

12. The apparatus according to claim 9, wherein the intermediate lifting means engage at the same end of the rocker as the high-lifting means and have with these in common at least one structural component, whose position relative to an apparatus-fixed system is changeable by means of the first drive means.

13. The apparatus according to claim 12, wherein the common structural component is formed by the positioning element.

14. The apparatus according to claim 12, wherein the pivot bearing of the rocker has a fixed position relative to an apparatus-fixed system.

15. The apparatus according to claim 1, wherein the first drive means comprise a unidirectionally acting hydraulic or pneumatic cylinder.

16. The apparatus according to claim 15, wherein the positioning element is formed as an extension of the piston rod of the cylinder.

17. The apparatus according to claim 1, wherein the locking means have a unidirectionally acting hydraulic or pneumatic cylinder for actuating the locking, and wherein the locking can be effected by clamping under a compressive force generated by the cylinder.

18. The apparatus according to claim 1, wherein the first drive means, the positioning element and the locking means are formed as a coherent unit.

19. The apparatus according to claim 1, wherein the apparatus has control means by which an automatic band thickness adjustment can be performed by automatically bringing the feed element coupled with the high-lifting means by means of the resetting forces from the high-lifted position into a band thickness position, in which it lies on the band-shaped material which is arranged between the feed elements and abuts to the other feed element, wherein the positioning element takes a position corresponding to the band thickness, and by then automatically locking the positioning element with the locking means in this position.

20. The apparatus according to claim 19 for the intermittent feeding of a band-shaped semi-finished material to a press, wherein the apparatus has intermediate lifting means with second drive means which are coupled with the first of the feed elements for moving the first of the feed elements from a clamping position, which is closer to the second of the feed elements, into an intermediate lifted position, which is located more remote from the second of the feed elements for the temporary release of the band-shaped material and wherein, before the locking of the positioning element, the intermediate lifting means are automatically brought into a specific state.

21. The apparatus according to claim 20, wherein the intermediate lifting means by the control means for the band thickness adjustment are automatically brought into a state that corresponds to the beginning of the intermediate lifting during feeding operation.

22. An apparatus for the intermittent feeding of a band-shaped semi-finished material to a press, with two feed elements located opposite each other for the feeding of the material in a feeding operation with clamping of the material between the feed elements, with high-lifting means having first drive means coupled with a first of the feed elements for the first of the feed elements to be movable from one position, which is closer to a second of the feed elements, into a high-lifted position, which is more remote from the second of the feed elements, in order to enable introduction of the material between the feed elements in a non-feeding operation, with band thickness adjusting means with a positioning element coupled with the first of the feed elements for movement between first and second positions, and with locking means by which the positioning element can be locked in a position between the first and second positions, wherein a force of the first drive means is exclusively in the direction towards the high-lifted position of the first of the feed elements, and a resetting movement of the feed elements for adjusting the apparatus to the thickness of the material from the high-lifted position into a band thickness position in which the feed elements lie on the material between the feed elements and, therefore, a positioning of the positioning element in a position corresponding to the band thickness position of the feed element is by resetting forces independent of the force of the first drive means, wherein the apparatus has intermediate lifting means with second drive means coupled with one of the feed elements for clamping the material between two successive feeding intervals by moving the one of the feed elements to a clamping position, which is closer to the other of the feed elements, from an intermediate lifted position, which is located more remote from the other of the feed elements for the temporary release of the band-shaped material, wherein the locking of the positioning element is effected when the intermediate lifting means are in a state which, during a feeding operation, corresponds to a beginning of the intermediate lifting means moving, wherein the first of the feed elements is the one coupled to the intermediate lifting means, wherein the feed elements are feed rollers or feed roller segments, wherein that particular feed roller or that particular feed roller segment, which is coupled with the intermediate lifting means, is mounted in a rocker which is mounted in a swivelling manner in a pivot bearing in the area of one of its two ends and, in the area of its other end, is coupled with the second drive means of the intermediate lifting means, so that it can be swivelled to and fro with these drive means around the pivot bearing, wherein the pivot bearing is coupled with the high-lifting means for changing the position of the pivot bearing relative to an apparatus-fixed system by means of the first drive means, and wherein the positioning element is guided along a guide and is lockable within this guide by frictional connection with clamping surfaces.

23. An apparatus for the intermittent feeding of a band-shaped semi-finished material to a press, with two feed elements located opposite each other for the feeding of the material in a feeding operation with clamping of he material between the feed elements, with high-lifting means having first drive means coupled with a first of the feed elements for the first of the feed elements to be movable from one position, which is closer to a second of the feed elements, into a high-lifted position, which is more remote from the second of the feed elements, in order to enable introduction of the material between the feed elements in a non-feeding operation, with band thickness adjusting means with a positioning element coupled with the first of the feed elements for movement between first and second positions, and with locking means by which the positioning element can be locked in a position between the first and second positions, wherein a force of the first drive means is exclusively in the direction towards the high-lifted position of the first of the feed elements, and a resetting movement of the feed elements for adjusting the apparatus to the thickness of the material from the high-lifted position into a band thickness position in which the feed elements lie on the material between the feed elements and, therefore, a positioning of the positioning element in a position corresponding to the band thickness position of the feed element is by resetting forces independent of the force of the first drive means, wherein the apparatus has intermediate lifting means with second drive means coupled with one of the feed elements for clamping the material between two successive feeding intervals by moving the one of the feed elements to a clamping position, which is closer to the other of the feed elements, from an intermediate lifted position, which is located more remote from the other of the feed elements for the temporary release of the band-shaped material, wherein the locking of the positioning element is effected when the intermediate lifting means are in a state which, during a feeding operation, corresponds to a beginning of the intermediate lifting means moving, wherein the first of the feed elements is the one coupled to the intermediate lifting means, wherein the feed elements are feed rollers or feed roller segments, wherein that particular feed roller or that particular feed roller segment, which is coupled with the intermediate lifting means, is mounted in a rocker which is mounted in a swivelling manner in a pivot bearing in the area of one of its two ends and, in the area of its other end, is coupled with the second drive means of the intermediate lifting means, so that it can be swivelled to and fro with these drive means around the pivot bearing, wherein the intermediate lifting means engage at the same end of the rocker as the high-lifting means and have in common at least one structural component with a position relative to the apparatus changeable by means of the first drive means, wherein the pivot bearing of the rocker has a fixed position relative to the apparatus, and wherein the positioning element is guided along a guide and is lockable within this guide by frictional connection with clamping surfaces.

24. A method for the adjusting of the band thickness of a feed apparatus according to claim 1, the method including the steps of:

a) Moving the one feed element with the high-lifting means under activation of the first drive means into a high-lifted position;

b) Introducing a band-shaped material into the area between the two feed elements;

c) Neutralising the effect of the high-lifting means at a simultaneous exclusion of a transmission of drive forces from the first drive means to the feed element in a movement direction opposite to the high-lifting movement;

d) Moving the one feed element by resetting forces independent of the drive forces of the first drive means from the high-lifted position in a direction opposite to the high-lifting movement into a band thickness position in which the feed element lies on the band-shaped material which is arranged between the two feed elements and lies on the other feed element, wherein a positioning element which is movably joined to the one feed element is positioned in a position corresponding to the band thickness; and e) Locking the one feed element in the band thickness position by locking the positioning element which is moving-connected to it, in the corresponding position with locking means.

25. The method according to claim 24, wherein spring and/or weight forces are exclusively used for the movement of the one feed element from the high-lifted position into the band thickness position.

26. The method according to claim 24, wherein the positioning element is guided translatorically, and is locked within this guide by means of clamping.

27. The method according to claim 24, wherein, between the feeding intervals in each case, the clamping of the band-shaped material is suspendable for the temporary release of said material, in that a first of the two feed elements is moveable with intermediate lifting means from a clamping position which is closer to the second feed element into an intermediate lifting position which is more remote from the second feed element, wherein the intermediate lifting means are brought into a specific state before the locking of the positioning element.

28. The method according to claim 27, wherein the intermediate lifting means, before the locking of the positioning element, are brought into a situation which corresponds to the beginning of the intermediate lifting during feeding operation.

29. The method according to claim 24, wherein at least the method steps c) to e) are carried out in automated fashion with the help of an in particular electronic control system.

30. A method for the adjusting of the band thickness of a feed apparatus for advancing a band-shaped material in a feeding operation by means of two feed elements located opposite one another clamping the band-shaped material between said feed elements, and for making possible an introduction of the band-shaped material into the area between the two feed elements in a non-feeding operation when one of the feed elements is moveable with high-lifting means with first drive means in a direction away from the other feed element into a high-lifted position, the method including the steps of:

a) Moving the one feed element with the high-lifting means under activation of the first drive means into a high-lifted position;

b) Introducing a band-shaped material into the area between the two feed elements;

c) Neutralising the effect of the high-lifting means at a simultaneous exclusion of a transmission of drive forces from the first drive means to the feed element in a movement direction opposite to the high-lifting movement;

d) Moving the one feed element by resetting forces independent of the drive forces of the first drive means from the high-lifted position in a direction opposite to the high-lifting movement into a band thickness position in which the feed element lies on the band-shaped material which is arranged between the two feed elements and lies on the other feed element, wherein a positioning element which is movably joined to the one feed element is positioned in a position corresponding to the band thickness; and e) Locking the one feed element in the band thickness position by locking the positioning element which is moving-connected to it, in the corresponding position with locking means, wherein, between the feeding intervals in each case, the clamping of the band-shaped material is suspendable for the temporary release of said material, in that a first of the two feed elements is moveable with intermediate lifting means from a clamping position which is closer to the second feed element into an intermediate lifting position which is more remote from the second feed element, wherein the intermediate lifting means are brought into a specific state before the locking of the positioning element and wherein at least the method steps c) to e) are carried out in automated fashion with the help of an in particular electronic control system, and wherein the positioning element is guided along a guide and is lockable within this guide by frictional connection with clamping surfaces.

* * * * *